US007252028B2

(12) United States Patent
Bechtold et al.

(10) Patent No.: US 7,252,028 B2
(45) Date of Patent: Aug. 7, 2007

(54) DEVICE AND METHOD FOR BRAIDING A CORE

(75) Inventors: Michael Bechtold, Moensheim (DE); Frank Strachauer, Starnberg (DE); Marc Giebels, Eindhoven (NL); Hendrikus Van Der Laak, Maarheeze (NL); Haro Van-Panhuys, Eindhoven (NL); Arnold Voskamp, Sittard (NL)

(73) Assignees: DaimlerChrysler AG, Stuttgart (DE); Eurocarbon B.V., Sittard (NL)

( * ) Notice: Subject to any disclaimer, the term of this patent is extended or adjusted under 35 U.S.C. 154(b) by 0 days.

(21) Appl. No.: 10/539,755

(22) PCT Filed: Dec. 18, 2003

(86) PCT No.: PCT/EP03/14568

§ 371 (c)(1),
(2), (4) Date: Apr. 11, 2006

(87) PCT Pub. No.: WO2004/057082

PCT Pub. Date: Jul. 8, 2004

(65) Prior Publication Data

US 2006/0207415 A1 Sep. 21, 2006

(30) Foreign Application Priority Data

Dec. 19, 2002 (DE) ..... 102 59 593

(51) Int. Cl.
*D04C 3/48* (2006.01)

(52) U.S. Cl. ..... 87/34

(58) Field of Classification Search ..... 87/6, 87/29, 34, 62
See application file for complete search history.

(56) References Cited

U.S. PATENT DOCUMENTS

| | | | | |
|---|---|---|---|---|
| 4,228,207 | A | 10/1980 | Porte et al. | |
| 4,494,436 | A * | 1/1985 | Kruesi | 87/23 |
| 4,519,290 | A * | 5/1985 | Inman et al. | 87/7 |
| 5,476,027 | A * | 12/1995 | Uchida et al. | 87/29 |
| 6,679,152 | B1 | 1/2004 | Head et al. | |
| 2001/0021427 | A1 * | 9/2001 | Cundiff et al. | 428/36.3 |

FOREIGN PATENT DOCUMENTS

| | | |
|---|---|---|
| EP | 0307112 | 3/1989 |
| EP | 0 902 114 A2 | 3/1999 |

OTHER PUBLICATIONS

German Office Action dated Oct. 27, 2005 (Five (5) Pages).

* cited by examiner

*Primary Examiner*—Shaun R. Hurley
(74) *Attorney, Agent, or Firm*—Crowell & Moring LLP

(57) ABSTRACT

A method and a device for braiding a rigid core with a braided structure with at least largely heavy-duty fibers and having regions with a differing number of layers. The device has a braiding machine, a linear displacing apparatus between the core and the braiding machine and a guiding apparatus for temporarily placing at least one element onto the uppermost layer of the braided structure in an automated manner, the at least one element having on the end face a defined stiff edge about which a braiding reversal may be created.

14 Claims, 2 Drawing Sheets

DEVICE AND METHOD FOR BRAIDING A CORE

This application claims the priority of German patent document 102 59 593.3 filed Dec. 19, 2002 (PCT International Application No. PCT/EP2003/014568, filed Dec. 18, 2003), the disclosure of which is expressly incorporated by reference herein.

The present invention relates to a device and a method for the automated braiding of a core with a multilayered braided structure with at least largely heavy-duty fibers and having regions with a differing number of layers.

Such braided structures form the core of a component of fiber-reinforced plastic, for which purpose the braided structure is fixed in a mold and the curing plastic is injected into this mold. This procedure is used in particular in the case of a fiber-reinforced plastic with a very high fiber content. The fiber-reinforced plastic components created in this way have very high strength along with very low weight and are used for example in aviation and aerospace. A further possible use is in automobile construction, if the use of high-strength and nevertheless lightweight components is required.

The braided structure is created in a known way by a braiding machine. On account of the lack of inherent stability of a braided structure, in the production of a closed braid it is braided around a solid core which already represents the final contour to be obtained later. During this operation, the core and the braiding machine are moved in relation to each other in order to create a sheet-like structure. The thickness of the braid created can be controlled on the one hand by the thickness of a braided layer or on the other hand by the provision of a number of layers arranged one on top of the other. The braided structure of high-strength fibers in this case has adequately high inherent tension, so that the braid lies firmly against the core around which it is braided.

The invention is based on the object of producing with high precision a braided structure with a thickness differing in the direction of movement of the core in relation to the braiding machine.

This object is achieved by the device according to the invention.

With the device according to the invention it is possible to lay individual layers of the braided structure in a doubled manner by reversing the movement of the core to be braided in relation to the braiding machine. The element that can be brought into place in an automated manner by means of the guiding apparatus defines the doubling-over edge of the layer to be doubled over and for this purpose has on the end face a defined stiff edge.

The guiding apparatus advantageously has at least one horizontally and vertically movable arm, which acts on the element and with which the element, and consequently also the defined stiff edge for doubling over the layer, can be positioned in an automated manner.

In a favorable development, the element is arranged in such a way that it encloses the core, whereby a laying edge running around the core is formed.

It is also advantageous for the element to comprise at least two separate shells, one arm of the guiding apparatus being arranged on each shell, in order for example to be able to arrange a peripheral edge at the desired position even in the case of a non-cylindrical formation of the core.

In a further advisable development, the at least two shells can be braced against the core by means of a clamping element acting circumferentially on them. The shells are pressed with additional force against the braid and against the core, so that slipping on the braid is not possible.

In a favorable development, the device has at least one further clamping apparatus with a number of stem elements arranged in an annular manner around the core, these elements also advantageously having needles on the end faces. With the stem elements fitted with needles, the braid can be penetrated and held in its position with respect to the core.

It is also advisable in this case if the clamping apparatus can be made to move horizontally along the core to move to specific points and in this position then has means for radially moving the stem elements and for making the needles provided at the end faces penetrate into the braid. In this case it is also advisable if these means for radial movement are formed as pneumatic cylinders and consequently can be activated simply and individually.

The object on which the invention is based is achieved furthermore by the claimed method, the method being suitable in particular for use on the claimed device.

Further advantages and features of the invention can be taken from the description which follows in relation to the exemplary embodiment that is represented in the drawing and also from the individual patent claims.

DETAILED DESCRIPTION

Figure 1:
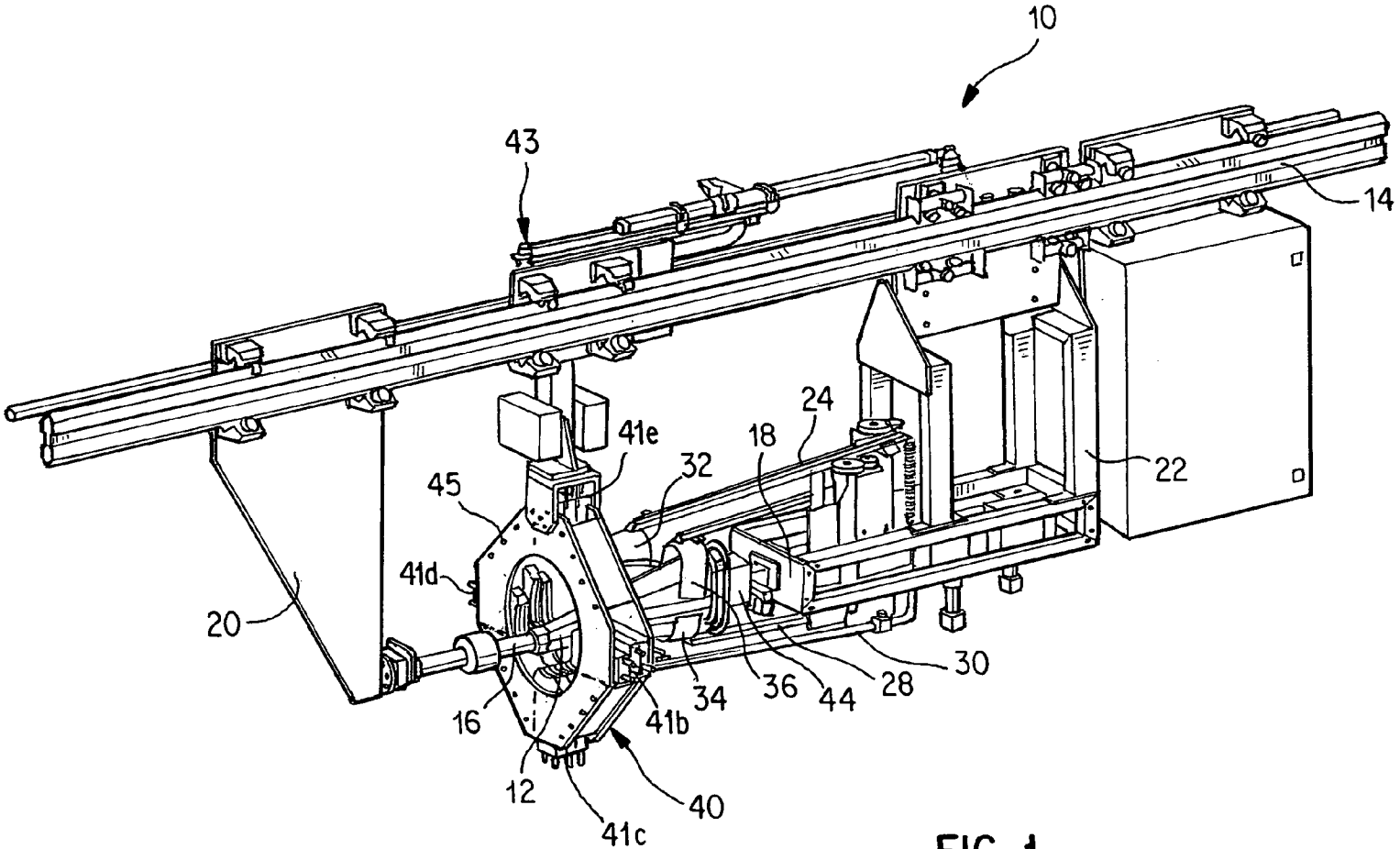
FIG. 1 shows a side view of a the linear displacing apparatus in accordance with an embodiment of the present invention, in a perspective representation.

The linear displacing apparatus 10 represented in FIG. 1 makes it possible for a conically formed core 12 to be braided in the way according to the invention with a high-strength fiber on a braiding machine (not represented). In the exemplary embodiment described, the high-strength fibers are carbon fibers. In the same way, however, aramid fibers or glass fibers may also be used. The braiding machine (not shown) is fixedly arranged, so that, to achieve a sheet-like braided structure on the core 12, the latter has to be moved in relation to the braiding machine. The linear displacing apparatus 10 has in this case a rail 14, which extends in the longitudinal direction and along which the core 12 is displaceable. The core 12 is secured at its front end on a pin 16 and at its rear end on a mount 18, the pin 16 and the mount 18 being arranged such that they can be made to move on the rail 14 in a coupled manner respectively by means of a holding element 20 and 22. The holding elements 20 and 22 forming the guiding apparatus together with a control system also serve at the same time as spacers between the rail 14 and the core 12. One reason why this spacing is necessary is to create adequate space for the braiding process (not represented), with which the core 12 is covered over its entire length (parallel to the rail 14) with a multilayered braided structure. While the braiding machine (not shown) is fixed in place, the core 12 is moved on the rail 14 by means of the holding elements 20 and 22 forming the guiding apparatus. In this case, a reversal of the braiding to form a multilayered braided structure can be initiated by a reversal of the movement of the core 12.

Arranged on the holding element 22 are four guiding arms 24, 26, 28, 30, which extend largely parallel to the rail 14 and at their front ends have shells 32, 34, 36, 38.

These shells 32, 34, 36, 38 can be placed against the core 12, or against the braided layer lying on top, by means of the arms 24, 26, 28, 30. With the shells, the braided structure, which under normal loading is held against the core 12 just on account of its internal tension provided by the braiding process, can also be held fixedly in its position on the core 12 even under very high tensile loads during the reversing process.

This is important in particular whenever the reversal of the braiding process is intended to take place at an exactly defined point of the conical core profile, in order to create a step on the finished component by means of a differing number of layers.

To support such a braiding reversal process, the device has a further, pneumatically operated clamping system 40 with a housing 45. The housing 45 of the clamping system 40 is likewise arranged displaceably on the rail 14 of the linear displacing apparatus 10 by means of a mount 43 and surrounds the core 12 in a largely annular manner. At positions—four in the example described—distributed uniformly over the inner circumference of the housing 45 of the clamping system 40, stem elements 41*a*, 41*b*, 41*c*, 41*d* are arranged. The stem elements can be brought to bear against the core 12 by means of a pneumatic apparatus (not shown). In the example shown, three pairs of four stems are realized, arranged one behind the other in the longitudinal direction of the core. One element in each case of the pairs of four stems is in this case arranged respectively on a stem element 41*a*, 41*b*, 41*c*, 41*d*. With each pair of four, a reversal point can be produced.

At the end face, the individual stems of the stem elements 41*a*, 41*b*, 41*c*, 41*d* have needles, which, when the stem element bears against the core 12, enter the braided layer surrounding the core and fix the braided layers in this position in the longitudinal direction. Each of the individual stems can be actuated individually by means of hydraulic cylinders, the individual stems interacting in pairs of four being actuated in a synchronized manner.

The core 12 consists of rigid foam, in order to make it possible for the braided layers to be penetrated and for them to be made to bear firmly against the core by the needles.

The clamping system 40 can be displaced along the rail 14 independently of the core 12, in order to make it possible for the clamping system 40 to be positioned at various positions along the longitudinal axis of the core.

The braided structure created on the conically formed core 12 is intended to have a conical profile and a differing number of braided layers over the length of the core 12 (parallel to the rail 14). To produce such a braided structure, use is made of a braiding reversal process, in which the movement of the core 12 with respect to the stationary braiding machine is stopped at at least one defined point and the movement is continued in the opposite direction. In the region of the core that is passed over twice in this way, a doubled braided layer is consequently created, while other regions of the core are not provided with a further braided layer at all as result of the reversal of the movement.

The difficulty of this reversed braiding process is that the defined reversal point of the braided layer is to be created by a defined reversal edge. For this purpose, at the moment of the reversal of the movement of the core 12, the braided layer must be prevented from being displaced with respect to the latter. The self-stabilization of the braided layer on the core on account of the inherent tension of the braided structure only comes into effect when the braided layer is of a certain length.

For this purpose, in the braiding reversal process the braided layer that is respectively uppermost is held in its position and fixed by the shells 32, 34, 36, 38 and the stem elements 41*a*, 41*b*, 41*c*, 41*d*.

The braiding machine (not shown) is positioned in such a way that the core 12 is braided in the direction of the pin 16, starting from the mount 18.

In order to create the braided structure in the desired form of the core 12, the core is braided at first with at least two layers over its entire length, proceeding from the mount 18 to the pin 16 and back. If the next two layers are then not to be braided over the entire length of the core 12, a reversal of the movement of the core with respect to the braiding machine takes place at a defined point of the movement of the core 12. The movement of the core 12 with respect to the stationary braiding machine and its reversal are prescribed by means of a control system.

In the reversal of the braiding process, the shells 32, 34, 36, 38 are brought to bear against the outer braided layer on the core 12. In this case, the shells 34 and 36 and also 32 and 38 respectively act together, in that they are brought to bear against the core 12 in the same position in the longitudinal direction. In the reversal of the movement of the core 12, synonymous with the reversal of the braiding process, the front edges 32*a* and 38*a* of the shells 32 and 38 form a defined edge around which the braided layer being created at the time is led in the reversed braiding. In this way, the reversal point is exactly defined and consequently the beginning of the second braided structure is similarly established. Starting from the point of the braiding reversal, the braided structure is consequently thicker by two braided layers in the direction of the mount 18 than in the direction of the pin 16.

The front, defined edges 32*a*, 38*a* of the shells 32 and 38 are braided over by the new braided layer to the extent necessary for the definition of the desired reversal position of the braided layer.

In a further step, the double layer created in this way is fixed directly at the front edges 32*a*, 38*a* of the shells 32 and 38 by the clamping system 40 or its stem elements 41*a*, 41*b*, 41*c*, 41*d*. Here it is necessary that the clamping system 40 can likewise be displaced in an automated manner on the rail 14 into the region of the shells 32 and 38. When the new, doubled braided layer is fixed in its position with respect to the core 12 formed from rigid foam by the stem elements 41*a*, 41*b*, 41*c*, 41*d* and the needles arranged on the end faces of the latter, the shells 32, 34, 36, 38 are lifted off the core 12 again and brought into their original, inactive position in the region of the mount 18. In the case of the conical form of the core 12 provided here, the shells 32 and 38 already partly braided-over in the front region, facing the pin 16, in particular must be moved out in an iterative process both in the longitudinal direction and in the transverse direction in relation to the rail 14 between the two braided layers.

This operation of reversed braiding can be repeated at various points over the length of the core 12. In this case, however, it is advisable to ensure that the number of braided layers continuously increases or continuously decreases in the longitudinal direction of the core 12.

Figure 2:
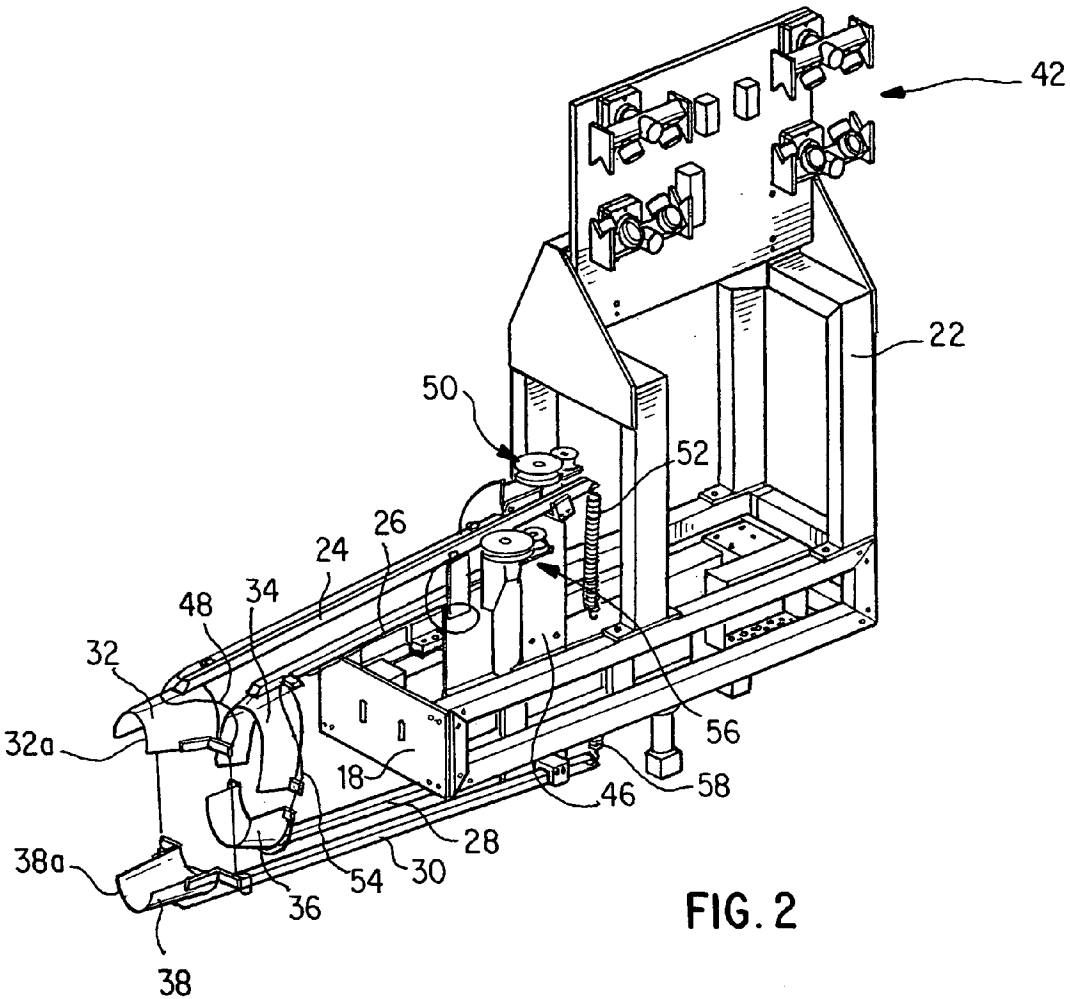
FIG. 2 shows the guiding apparatus for the clamping elements in an embodiment analogous to FIG. 1.

FIG. 2 shows the mount 18 with a roller arrangement 42, with which the mount is arranged displaceably on the rail 14 represented in FIG. 1. The mount 18 has, furthermore, a holding element 44, on which one end of the core 12 (not shown in this figure but in FIG. 1) is secured. Arranged in the region of this mount 18 is the mechanism 46 for positioning the shells 32, 34, 36, 38 by means of the arms 24, 26, 28, 30 respectively corresponding to them. The mechanism 46 can be displaced in the longitudinal direction with respect to the mount 18, in order to avoid impairment of the braiding by the shells 32, 34, 36, 38 during the normal braiding process. The shells are brought into their active position by means of the mechanism only in the case of the reversal of the braiding process. By pivoting the arms 24, 26, 28, 30, the shells 32, 34, 36, 38 are brought to bear against the braided layer lying on top on the core. The interacting shells 32 and 38 are connected by means of a peripheral cable 48, which is led around the core 12 in a circular manner. The cable 48 can be tightened by means of a roller system 50, so that the circle which the cable forms around the core is reduced and the shells 32 and 38 are pressed against the core by the force of the cable. This tightening of the shells 32 and 38 against the core takes place counter to the force of a spring 52, which effects lifting off of the shells 32 and 38 from the core when the tensile force in the cable 48 subsides. The shells 34 and 36 interact in a way analogous to a cable 54, a roller system 56 and a spring 58.

As evident in FIG. 2, the shells are adapted to the conical form of the core 12. Shells formed similarly by corresponding adaptation of their form can also be used to produce cylindrical or rectangular forms.

In the exemplary embodiment described, the rigid foam core 12 is braided with carbon fibers. The multilayered fibrous braided structure created is then impregnated with a plastic and cured in a downstream operation. The core 12 serves in the braiding process only as an inner form carrier for the flexible braided structure and does not constitute part of the later component in the application described. In principle, however, part of the finished component may also be formed by the form carrier.

In the regions of the braided structure in which a differing number of braided layers has been created by the reversed braiding process, defined step transitions are formed during curing. The method according to the invention, which is controlled in an automated manner, with the device likewise according to the invention allow the steps to be created at exactly predeterminable points.

The individual layers of carbon fiber braided onto the rigid foam core are tufted, in order to interconnect them captively. On account of the material properties of the rigid foam core, the tufting can be carried out before the core is removed, since the needles can penetrate into the rigid foam during the tufting.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A device for braiding a braided structure of at least largely of heavy-duty fibers having regions with a differing number of layers, comprising:

a braiding machine;

a fiber braiding core about which the braiding machine braids at least one layer of the braided structure;

a linear displacing apparatus for reversible displacement of the core relative to the braiding machine during braiding; and a guiding apparatus which places at least one element onto the uppermost layer of the braided structure in an automated manner during a braiding reversal, the at least one element having defined stiff edge about which the fiber braiding is reversed.

2. The device as claimed in claim 1, wherein the guiding apparatus has at least one horizontally and vertically movable arm acting on the at least one element.

3. The device as claimed in claim 1, wherein the at least one element is arranged to enclose the core.

4. The device as claimed in claim 3, wherein the element comprises at least two separate shells, each shell being positionable by an arm of the guiding apparatus.

5. The device as claimed in claim 4, wherein the at least two shells can be braced against the core by means of a clamping element acting circumferentially on them.

6. The device as claimed in claim 5, further comprising:

at least one further clamping apparatus with a plurality of stem elements arranged in an annular manner around the core.

7. The device as claim in claim 6, wherein the stem elements have needles on their end faces closest to the core.

8. The device as claimed in claim 7, wherein the at least one clamping apparatus is displaceable along the core and the stem elements are radially displaceable relative to the core.

9. The device as claimed in claim 8, wherein the stem element are radially displaced by pneumatic cylinders.

10. The device as claimed in claim 6, wherein the at least one clamping apparatus is arranged in a horizontally displaceable manner.

11. A method for producing a braided structure having regions with a differing number of layers, comprising the steps of:

braiding the braided structure in a number of layers onto a fiber braiding core wire a braiding machine, wherein the core is displaced relative to the braiding machine; and creating differing numbers of braided fiber layers in different regions of the core by reversing the movement of the core relative to the braiding machine, wherein, during at least one movement reversal, an element with a defined, stiff doubling-over edge is brought in an automated manner onto the uppermost braided layer to hold the braided layer at a predefined reversal point, and following the reversal movement, the braiding machine continues braiding to form a doubled-over braided layer.

12. The method as claimed in claim 11, further comprising the steps of:

fixing the doubled-over layer in an automated manner; and removing the element with the doubling-over edge away from the reversal point.

13. The method as claimed in claim 11, wherein at least one outer layer is braided over the entire length of the core.

14. The method as claimed in claim 11, wherein the individual layers are interconnected by tufting.

* * * * *